US009903032B2

(12) United States Patent
Pelkus

(10) Patent No.: US 9,903,032 B2
(45) Date of Patent: Feb. 27, 2018

(54) AQUATIC METAL ION HARVESTING DEVICE AND SYSTEM

(71) Applicant: Adrian Pelkus, San Marcos, CA (US)

(72) Inventor: Adrian Pelkus, San Marcos, CA (US)

( * ) Notice: Subject to any disclaimer, the term of this patent is extended or adjusted under 35 U.S.C. 154(b) by 151 days.

(21) Appl. No.: 14/773,361

(22) PCT Filed: Mar. 13, 2014

(86) PCT No.: PCT/US2014/025550
§ 371 (c)(1),
(2) Date: Sep. 7, 2015

(87) PCT Pub. No.: WO2014/159974
PCT Pub. Date: Oct. 2, 2014

(65) Prior Publication Data

US 2016/0024671 A1 Jan. 28, 2016

Related U.S. Application Data

(60) Provisional application No. 61/781,453, filed on Mar. 14, 2013.

(51) Int. Cl.

| | |
|---|---|
| ***C25C 7/00*** | (2006.01) |
| ***C25C 1/00*** | (2006.01) |
| ***C25C 1/20*** | (2006.01) |
| ***C25C 7/02*** | (2006.01) |

(52) U.S. Cl.
CPC ..... *C25C 7/007* (2013.01); *C25C 1/00* (2013.01); *C25C 1/20* (2013.01); *C25C 7/00* (2013.01); *C25C 7/02* (2013.01)

(58) Field of Classification Search
CPC .... C25C 1/00; C25C 1/20; C25C 7/00; C25C 7/007; C25C 7/02; C25C 7/06
USPC ..... 204/228.1; 205/337, 571
See application file for complete search history.

(56) References Cited

U.S. PATENT DOCUMENTS

| | | | | |
|---|---|---|---|---|
| 3,925,184 A * | 12/1975 | Cave | C25C 7/00 | 204/218 |
| 4,151,051 A * | 4/1979 | Evans | C25B 1/00 | 204/194 |
| 5,102,513 A * | 4/1992 | Pelkus | G05F 1/468 | 204/229.2 |
| 6,451,183 B1 * | 9/2002 | Treasure | C25C 5/02 | 204/269 |

* cited by examiner

*Primary Examiner* — Susan D Leong
*Assistant Examiner* — Joshua L Allen
(74) *Attorney, Agent, or Firm* — David B. Waller

(57) ABSTRACT

The present invention is a device and system for recovering metal ions from bodies of water. The device comprises two electrode cylinders, a keel, at least two connectors, a buoyant housing and a power supply. The first electrode cylinder comprises a top, a bottom, an exterior surface, a longitudinal axis and a means for connecting to a power supply. The second electrode cylinder is affixed within the first electrode cylinder by a bracket and has a means for connecting to a power supply. The keel is affixed to the bottom of the exterior surface along the longitudinal axis of the first electrode cylinder. There are least two connectors affixed to the top along the longitudinal axis of the first electrode cylinder.

13 Claims, 4 Drawing Sheets

AQUATIC METAL ION HARVESTING DEVICE AND SYSTEM

CROSS-REFERENCE TO RELATED APPLICATIONS

This application claims the benefit of the filing date of PCT/US2014/025550 filed 16 Jun. 2014 under 35 U.S.C. § 371 and the filing date of provisional patent application Ser. No. 61/781,453 filed Mar. 14, 2013 from which the PCT application claims priority.

STATEMENT REGARDING FEDERALLY SPONSORED RESEARCH OR DEVELOPMENT

None

INCORPORATION-BY-REFERENCE OF MATERIAL SUBMITTED ON COMPACT DISC

None

BACKGROUND OF THE INVENTION

(1) Field of the Invention

The present invention relates to devices used for extracting heavy metal ions from aqueous solutions. Specifically, devices able to extract and/or harvest heavy metal ions utilizing a defined electrical potential that may be deployed in large bodies of salt or fresh water.

(2) Description of Related Art

Over 70% of the surface of the earth is covered with water. It is estimated that there are over 321 billion cubic miles of water in the ocean. This water contains a proportional amount of metal ions distributed in varying concentrations throughout the world. For precious metals such as gold and platinum their concentrations can range from about 5 parts per trillion (ppt) to about 50 ppt. This translates to approximately 5 to 50 kilograms per cubic kilometer of ocean water. This makes the ocean one of the largest storehouses of precious metals such as gold in the world.

However, the ability to screen such large volumes of ocean water to extract sufficient gold to make the process profitable has been the greatest hurdle. Today, with the value of gold increasing and new innovations in precious metal extraction, the cost to screen large volumes of ocean water may reach the break-even point in the near future. Consequently, there is a need for a device that can efficiently harvest gold metal ions from large volumes of ocean water at low cost.

BRIEF SUMMARY OF THE INVENTION

The present invention is a device for recovering metal ions from bodies of water comprising two electrode cylinders, a keel, at least two connectors, a buoyant housing and a power supply. The first electrode cylinder comprises a front end, a top, a bottom, an exterior surface and a longitudinal axis. The second electrode cylinder is affixed within the first electrode cylinder by a bracket. The keel is affixed to the bottom of the exterior surface along the longitudinal axis of the first electrode cylinder. There are least two connectors affixed to the top along the longitudinal axis of the first electrode cylinder. The buoyant housing comprises an underwater surface and has at least one cable affixed to the underwater surface able to receive at least two connectors of the first electrode. The power supply may be affixed within the buoyant housing and provides variable voltage to the first and second electrode cylinders.

The power supply comprises a DC energy source, a rectifier circuit, a voltage regulator circuit, and a controller. The rectifier circuit has an input and output connection. The DC energy source is connected to the rectifier input. The voltage regulator circuit has an input and first and second outputs. The voltage regulator circuit input is connected to the rectifier circuit output. The voltage regulator circuit has an input and first and second outputs. The voltage regulator circuit input is connected to the rectifier circuit output. The first voltage regulator circuit output provides plating voltage to the second electrode plating cylinder and a sampling voltage. The sampling voltage and the plating voltage being unequal. The controller comprises a microprocessor, a memory means, switching means, a timing means and a monitoring means. The monitoring means comprises a first input and a second input. The first monitoring means input is connected to the second output of the voltage regulator circuit. The second monitoring means input receives electrical signals from the first electrode cylinder. The monitoring means periodically samples the signals to determine whether a current is drawn across the first and second electrode cylinders by the aqueous solution. The current is measured by the application of a sampling voltage to one of the electrodes. The electrical signal generated is converted into digital input signals readable by the microprocessor. The means for converting then converts the digital output signals generated by the microprocessor into an analog output signal for controlling the variable voltage.

The first electrode cylinder may further comprise a mesh covering the front end. In addition, the second electrode cylinder may be removably affixed within the first electrode cylinder.

The buoyant housing may further comprise one or more ballast tanks, one or more thrusters connected to the controller, wherein the thrusters are positioned on the underwater surface, or a pump wherein the pump is connected to the controller and in fluid connection with one or more ballast tanks.

In one embodiment the monitoring circuit includes means for substantially continuously measuring said current and comparing the current to a predetermined current threshold during application of the plating voltage.

In a second embodiment the controller comprises means for monitoring at least two of a plurality of parameters comprising current, the variable voltage, the predetermined current threshold and a predetermined voltage threshold sequentially in a continuous stream. Further the controller may comprise a display circuit for indicating the at least two parameters or a global positioning means able to activate one or more thrusters to control the positioning of the device. In addition, the controller may be operated remotely.

In a third embodiment the analog output signal is responsive to the substantially continuous measuring means such that adjustments in the analog output signal occur at the same frequency as measuring by the substantially continuous measuring means.

In a fourth embodiment the DC energy source may be a battery connected to at least one solar panel or at least one piezoelectric strip.

Other aspects of the invention are found throughout the specification.

DETAILED DESCRIPTION OF THE INVENTION

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

1. Method for Harvesting Metal Ions from Solution

A variety of methods are known in the art for extracting heavy metal ions, such as gold from an aqueous solution. U.S. Pat. No. 5,102,513 discloses one of these methods incorporated herein in its entirety. This system comprises a microprocessor that constantly monitors the actual voltage, actual current, preset voltage and preset current at the electrodes of the plating system. The microprocessor makes adjustments to maintain the voltage at a preset level by outputting a digital signal to a digital-to-analog converter which changes the digital command into a voltage which is used to adjust an output transistor which controls the voltage to the electrodes. This system applies digital technology for rapid sampling and response for providing a smooth output waveform to apply constant plating voltage as desired.

2. Harvesting Device

Figure 1:
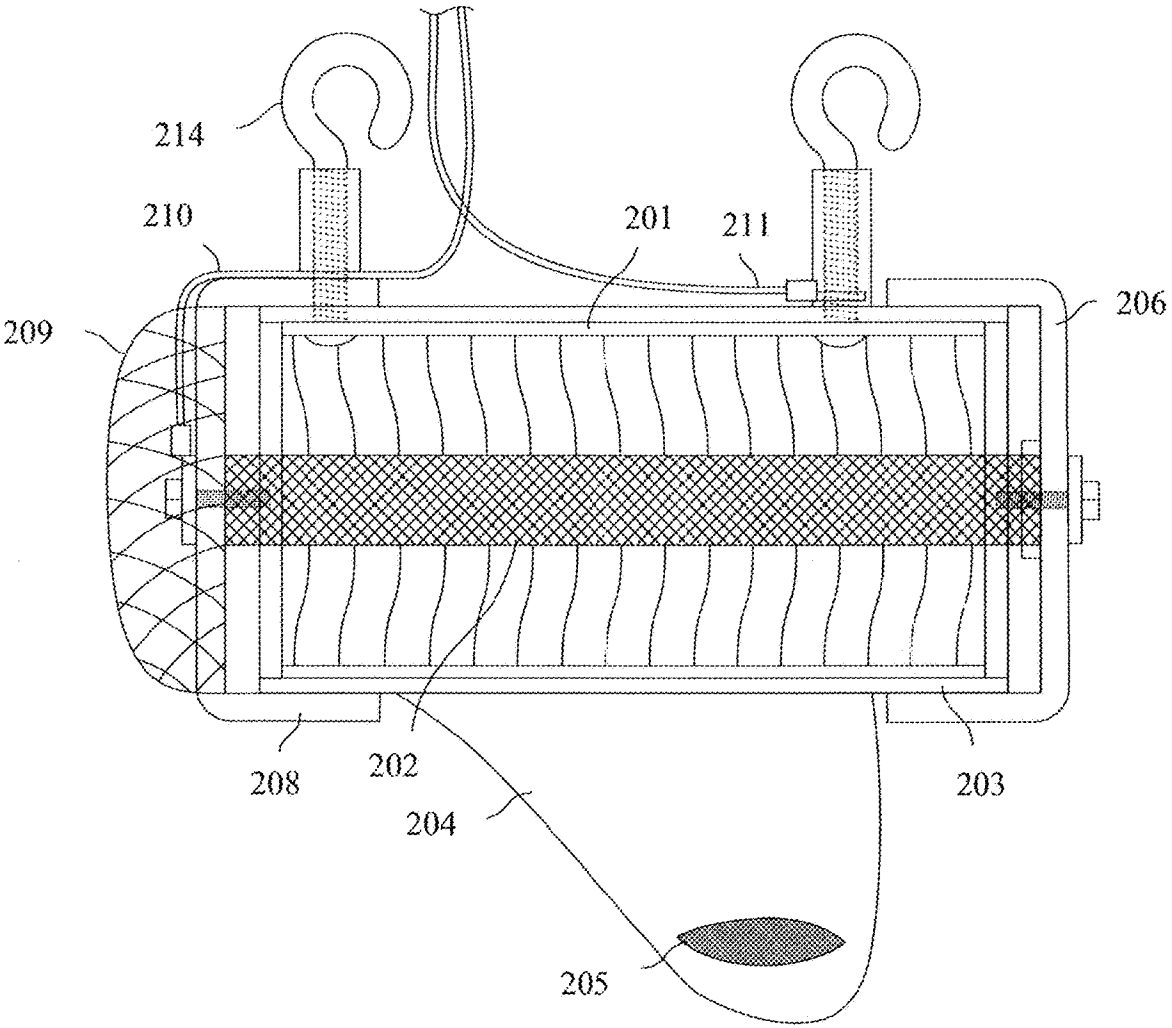
FIG. 1 is a side cross sectional view of an exemplary harvesting device of the present invention.
Figure 2:
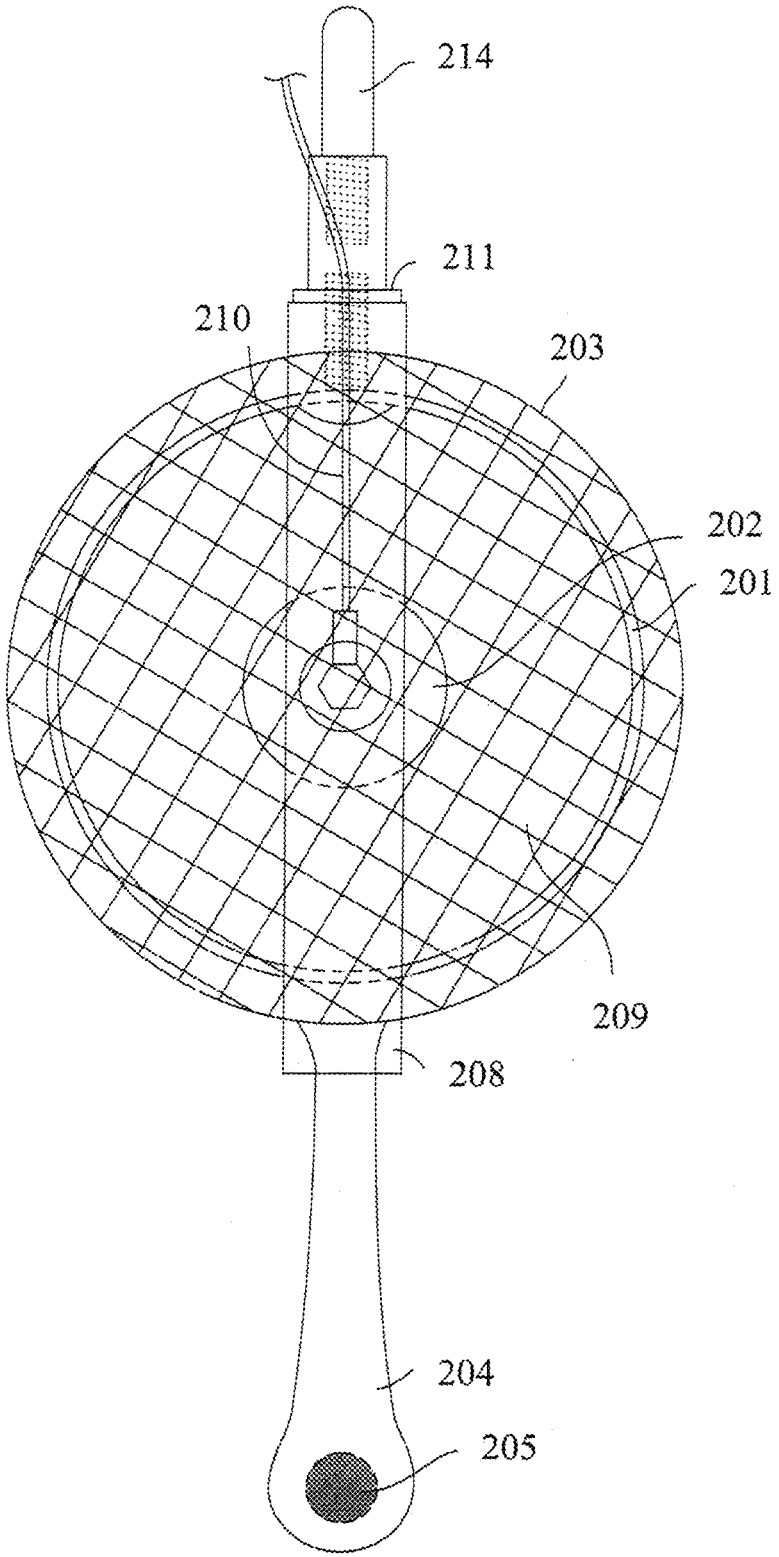
FIG. 2 is a front-end view of the exemplary harvesting device in FIG. 1.

One aspect of the present invention is a device 210 for recovering metal ions from bodies of water comprising two electrode cylinders able to be connected to a power supply, a keel and at least two connectors. FIG. 1 shows one example of an aquatic metal ion-harvesting device of the present invention. The device generally includes first and second electrodes, a keel and at least two connectors. The first electrode cylinder 201 comprises a front-end bracket 208, a back end bracket 206, a top, a bottom, an exterior surface 203 and a longitudinal axis. The second electrode cylinder 202 is affixed within the first electrode cylinder by brackets 206 and 208. The keel 204, that may be weighted 205, is affixed to the bottom of the exterior surface along the longitudinal axis of the first electrode cylinder. At least one connector 214 is affixed to the top along the longitudinal axis of the first electrode cylinder. The device may further comprise a mesh 209 that acts as a protective grill for the first and second electrode cylinders. Power to the first electrode is supplied through wire 211 and wire 210 affixed to the second electrode cylinder 202 provides electrical connection to the second electrode. The aquatic metal ion-harvesting device is towable or suspendable in water by connectors 214. FIG. 2, shows the front of the aquatic metal ion-harvesting device in FIG. 1.

3. Harvesting System

A second aspect of the present invention is a system for recovering metal ions from bodies of water comprising one or more of the devices described above connected to a buoyant housing. The buoyant housing comprises a DC energy source, a rectifier circuit, a voltage regulator circuit, and a controller. The rectifier circuit has an input and output connection. The DC energy source is connected to the rectifier input. The voltage regulator circuit has an input and first and second outputs. The voltage regulator circuit input is connected to the rectifier circuit output. The first voltage regulator circuit output provides plating voltage to the second electrode plating cylinder and a sampling voltage. The sampling voltage and the plating voltage being unequal. The controller comprises a microprocessor, a memory means, switching means, a timing means and a monitoring means. The monitoring means comprises a first input and a second input. The first monitoring means input is connected to the second output of the voltage regulator circuit. The second monitoring means input receives electrical signals from the first electrode cylinder. The monitoring means periodically samples the signals to determine whether a current is drawn across the first and second electrode cylinders by the aqueous solution. The current is measured by the application of a sampling voltage to one of the electrodes. The electrical signal generated is converted into digital input signals readable by the microprocessor. The means for converting then converts the digital output signals generated by the microprocessor into an analog output signal for controlling the variable voltage.

Figure 3:
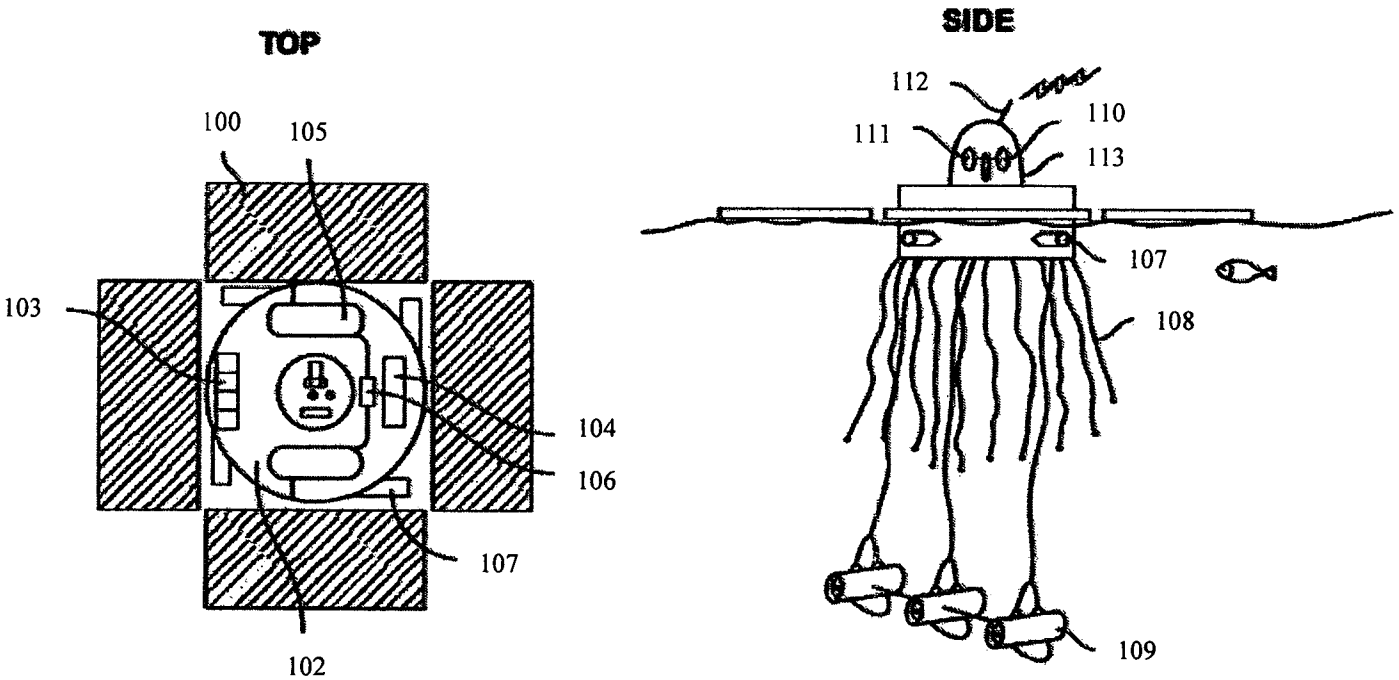
FIG. 3 shows a top view and a side view of an exemplary self-contained free floating aquatic metal ion harvesting system containing one or more of the harvesting devices of FIGS. 1 and 2.

FIG. 3, shows a top view and side view of an example of one aquatic metal ion-harvesting system of the present invention. The system generally comprises a buoyant housing 102 containing an energy storage means 103, a renewable energy-harvesting source, one or more ballast tanks 105, one or more thrusters 107 and one or more pumps 106. The renewable energy source may include solar panels 101, and/or piezo electric strips 108 to supply power to energy storage means 103 that may be one or more recharge batteries. The system controller 104, may have a wireless connection 112 for remote control and data transfer, a camera 110 with light 111 may also be housed on top of said vessel under a clear protective dome 113. The system is mobile, positioned by thrusters 107, submerged and resurfaced by controlling ballast tanks 105, driven by pump 106. The side view of the aquatic metal ion-harvesting system in FIG. 3 shows one or more aquatic metal ion harvesting devices 109 shown in FIGS. 1 and 2.

Figure 4:
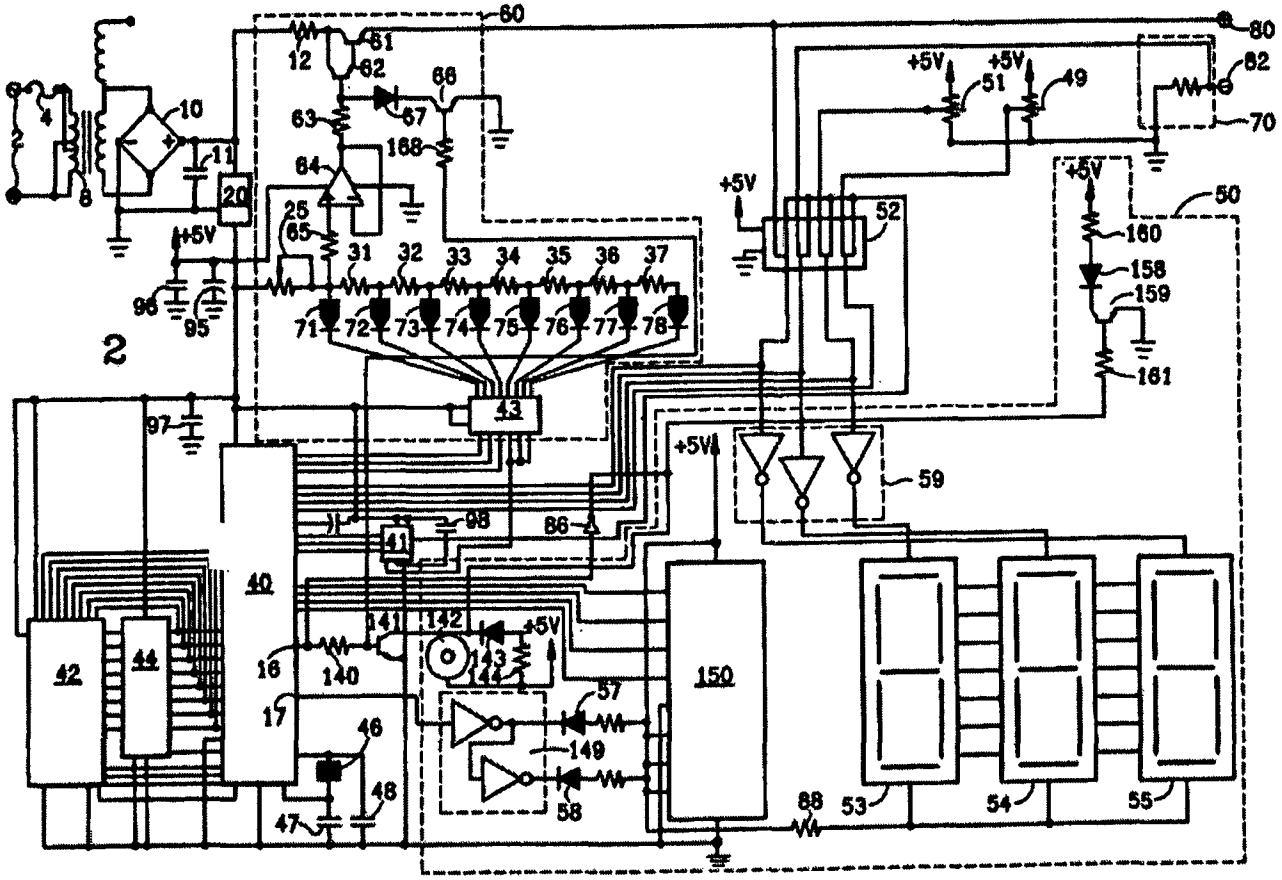
FIG. 4 is a schematic electric circuit diagram of one embodiment of the present invention.

Referring to FIG. 4, which shows a detailed embodiment of the power supply, a microprocessor 40 is adapted to control the output voltage, display of output voltage and current, and regulation functions of the power supply. Microprocessor 40 operates in accordance with software instructions stored in an erasable programmable read-only memory (EPROM) 42. Software instructions are retrieved and stored in a temporary memory latch 44 from which they are passed to microprocessor 40 in a manner well-known in the art. Microprocessor 40 operates at a 3.579 MHz clock rate, which is established by a clock circuit comprising a crystal 46, and the two capacitors 47 and 48.

Microprocessor 40, operating under stored program control, monitors the four circuit parameters comprising actual output voltage, actual output current, preset reference voltage, and preset reference current. The preset reference voltage is established by adjusting variable resistor 49 while monitoring the appropriate test point. The preset reference current is established by adjusting resistor 51 while monitoring the appropriate test point (not shown). These four parameters are continuously and sequentially sampled by a quad switch 52. Switch SW1 is a double pole double throw momentary switch which permits the operator to substitute preset reference voltage and current for actual output voltage and current into quad switch 52. When SW1 is in its momentary position, the preset reference voltage is provided to the first and third inputs to quad switch 52 and the preset reference current is provided to the second and fourth inputs to quad switch 52. Microprocessor 40 causes quad switch 52 to sequentially step through the four measurements by means of four control lines from microprocessor 40 to quad switch 52.

Thus, microprocessor 40 raises the first sample line while holding the other three sample lines down. Quad switch 52 then connects the selected analog variable of the input to an analog-to-digital (A/D) converter 41. A/D converter 41 then converts the selected analog variable to a single word, comprising eight bits, which is then passed to microprocessor 40. After the analog sample has settled and the output of A/D converter 41 has stabilized, microprocessor 40 then drops the first sample line and raises the second sample line. This causes quad switch 52 to connect the next analog variable to A/D converter 41. This process continues sequentially through the four analog variables and then restarts. The sampling of each parameter is substantially continuous in that any delay between subsequent readings of the same parameter is only the switching time to step through the other three parameters.

After each analog variable is sampled and read, microprocessor 40 makes adjustments to the output voltage as necessary to keep it equal to the preset reference voltage by computing an error level and passing a three-bit byte error value to a digital-to-analog (D/A) converter 43. D/A converter 43 converts the three-bit error value into an analog error signal by selectably connecting the eight individual resistors 31 through 37 to ground through individual diodes 71 through 78 as shown. The sensitivity of this error signal is established by adjusting resistor 25 while monitoring the analog error signal voltage on an appropriate test point (not shown).

This analog error signal is passed to operational amplifier 64, which serves to isolate the output voltage control circuit from the digital-to-analog conversion circuit. The output from op amp 64 is passed through series resistor 63 to the base of a Darlington transistor-pair, comprising driver transistor 62 and output transistor 61, whereby output transistor 61 is biased to correct the error in the actual output voltage. The Darlington transistor-pair 62 and 61 acts as a series voltage regulator in the manner well-known in the art.

Microprocessor 40 also monitors the actual output current and displays both the output current and output voltage using a three-digit digital display comprising a display driver 150 and three seven-segment display chips 53 through 55. Microprocessor 40 first convert the actual output voltage to a series of four-bit words corresponding to the three decimal display digits and passes these four-bit words in sequence to display driver 150. Three of the four control lines between microprocessor 40 and quad switch 52 discussed above are used to multiplex the three seven-segment display chips 53 through 55. A fifth control line from microprocessor 40 selects one of two LED diode indicators 57 and 58. This multiplexing and indicator selection process requires a plurality of inverters which are provided by a multiple inverter chip 149. (The inverters are indicated by reference numerals 59 and 149 due to their location in the schematic. All inverters may physically be on the same chip.)

The multiplex control signals to display chips 53 through 55 are passed through three inverters contained in chips 59 and 149. Two more inverters from chip 149 are configured so that diode 57 is illuminated when a selection signal from pin 17 of microprocessor 40 is low and diode 58 is illuminated when the pin 17 selection signal is high. This pin 17 selection signal alternates every four seconds and is synchronized with the alternation of output voltage and output current data on the four-bit data bus from microprocessor 40 to display driver 150

The digital data at display driver 150 is decoded and sent to display chips 53, 54 and 55. The three multiplex lines from microprocessor 40 step across display chips 53 through 55 every few milliseconds in synchronization with the shifting of display digit data from microprocessor 40. Thus, within the four-second period for the display of a single parameter, microprocessor 40, rapidly switches from the most significant digit (MSD) through the middle digit to the least significant digit (LSD) of the three-digit display. The multiplexing lines are synchronized with this shift in data in a well-known manner such that the three-digit display is driven by a single display driver (150) in a flicker-free display. At the end of the first four-second period, the control line at pin 17 of microprocessor 40 logically shifts and the same process occurs for the other display variable. The result of this circuit is a four-second display of actual output voltage accompanied with a lighted indicator 58, following by a four-second display of actual output current accompanied by a lighted LED indicator 57. This process continues indefinitely.

When the plating operation is active, a LED 158 is illuminated by means of a driver circuit comprising transistor 159 and resistors 160 and 161. When the power supply is not able to raise actual output levels to match the preset parameters for voltage and current, a lockout circuit comprising transistor 66 and diode 67 is engaged. This lockout circuit forces the voltage at the base of the Darlington pair 61 and 62 to within two diode voltage drops of ground, thereby effectively interrupting the output of the power supply.

The lockout condition is initiated by microprocessor 40 when it raises the voltage on pin 16 in response to software interpretation of actual output voltage and current values. A voltage on pin 16 turns on transistor 141 through base resistor 140 and transistor 66 through base resistor 168. Turning on 141 activates a piezoelectric sonic alarm 142 and illuminates lockout indicator diode 143 through resistor 144. The voltage on pin 16 is inverted by inverter 86 and applied to the base of transistor 159, which turns transistor 159 off. The conduction of transistor 66 forces the voltage at the base of transistor 62 down to a low value, which effectively turns off output transistor 61. With the output transistor 61 turned off, no output current exists at the power supply output electrodes 80 and 82. Microprocessor 40, under stored program control, attempts to reset the lockout condition by reactivating the power supply circuit after four seconds and remeasuring the output voltage and current conditions.

The logical components described above receive their +5 volts DC power from a five-volt regulator chip 20. A fuse 4 is provided in the primary AC side of center-tapped transformer 8 to protect the transformer from short-circuit currents. Transformer 8, with the center-tapped primary and secondary windings connected as shown, and full wave rectifier bridge 10, together with smoothing capacitor 11, provide an unregulated DC supply voltage of 25 volts. Series resistor 12 and output transistor 61 control the current flowing at the output in accordance with the control signals developed in the remainder of the circuitry as described above. Capacitors 95, 96, 97 and 98 provide local filtering of noise pulses on the 5 volt DC supply in a well-known manner.

The information set forth above is provided to give those of ordinary skill in the art a complete disclosure and description of how to make and use the embodiments of the device and methods, and are not intended to limit the scope of what the inventor regards as his invention. Modifications of the above-described modes (for carrying out the invention that are obvious to persons of skill in the art) are intended to be within the scope of the following claims. All publications, patents, and patent applications cited in this specification are incorporated herein by reference.

I claim:

1. A system for recovering metal ions from bodies of water comprising:

a first electrode cylinder having a front end, a top, a bottom, an exterior surface and a longitudinal axis;

a second electrode cylinder affixed within said first electrode cylinder by a bracket;

a keel affixed to said bottom of said exterior surface along said longitudinal axis of said first electrode cylinder;

at least two connectors affixed to said top along said longitudinal axis of said first electrode cylinder;

a buoyant housing having an underwater surface and at least one cable affixed to said underwater surface able to receive said at least two connectors; and a power supply for the application of variable voltage to said first and second electrode cylinders affixed within said buoyant housing, said power supply comprising:

a DC energy source;

a rectifier circuit having an input connected to said DC energy source and having an output;

a voltage regulator circuit having an input coupled to said rectifier circuit output and a first and a second output, said first output providing a plating voltage to said second electrode cylinder and a sampling voltage, said sampling voltage and said plating voltage being unequal; and a controller comprising a microprocessor, a memory means, switching means, a timing means and a monitoring means, said monitoring means having a first input connected to said second output of said voltage regulator, and a second input for receiving electrical signals from said first electrode cylinder, said monitoring means able to periodically sample said signals to determine whether a current is drawn across said first and second electrodes by said solution upon application of one of said sampling voltage or said plating voltage to said one of said electrodes and monitoring at least two of a plurality of parameters generated from said electrical signals into digital input signals readable by said microprocessor and means for converting digital output signals generated by said microprocessor into an analog output signal for controlling said variable voltage.

2. A system according to claim 1, further comprising a mesh covering said front end of said first electrode cylinder.

3. A system according to claim 1, wherein said second electrode cylinder is removably affixed within said first electrode cylinder.

4. A system according to claim 1, wherein said monitoring circuit includes means for measuring said current and comparing said current to a predetermined current threshold during application of said plating voltage.

5. A system according to claim 1, wherein said monitoring means monitors at least two of said signals, wherein said signals comprise current, a variable voltage, a predetermined current threshold and a predetermined voltage threshold sequentially in a continuous stream.

6. A system according to claim 1, wherein said controller further comprises a display circuit for indicating said at least two parameters.

7. A system according to claim 4, wherein said analog output signal is responsive to said measuring means such that adjustments in said analog output signal occur at the same frequency as measuring by said measuring means.

8. A system according to claim 1, wherein said DC energy source is a battery connected to at least one solar panel or at least one piezoelectric strip.

9. A system according to claim 1, wherein said buoyant housing further comprises one or more ballast tanks.

10. A system according to claim 1, wherein said buoyant housing further comprises one or more thrusters connected to said controller, said thrusters positioned on said underwater surface.

11. A system according to claim 9, wherein said buoyant housing further comprises a pump, said pump connected to said controller and in fluid connection with said one or more ballast tanks.

12. A system according to claim 1, wherein said controller is operated remotely.

13. A system according to claim 1, wherein said controller further comprises a global positioning system able to activate said one or more thruster and control the positioning of said device.

* * * * *